US007264640B2

(12) United States Patent
Waynick

(10) Patent No.: US 7,264,640 B2
(45) **Date of Patent: *Sep. 4, 2007**

(54) METHOD FOR IMPROVING THE PERFORMANCE OF ENGINES POWERED BY LIQUID HYDROCARBON FUEL

(75) Inventor: John Andrew Waynick, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 593 days.

This patent is subject to a terminal disclaimer.

(21) Appl. No.: 10/795,938

(22) Filed: Mar. 8, 2004

(65) Prior Publication Data

US 2004/0244280 A1 Dec. 9, 2004

Related U.S. Application Data

(63) Continuation-in-part of application No. 10/453,803, filed on Jun. 3, 2003, now Pat. No. 7,018,434.

(51) Int. Cl.
*C10L 1/12* (2006.01)

(52) U.S. Cl. ..... 44/457; 44/459; 210/728; 585/820; 585/823

(58) Field of Classification Search ..... 44/457, 44/459; 210/728; 585/820, 823
See application file for complete search history.

(56) References Cited

U.S. PATENT DOCUMENTS

| | | | |
|---|---|---|---|
| 1,198,039 | A | 9/1916 | Krause |
| 2,546,903 | A | 3/1951 | Morrell |
| 2,744,938 | A | 5/1956 | Urban, Jr. |
| 2,762,852 | A | 9/1956 | Litton |
| 3,366,582 | A | 1/1968 | Adams et al. |
| 3,977,969 | A | 8/1976 | Zall |
| 4,451,377 | A | 5/1984 | Luxemburg |
| 4,502,957 | A | 3/1985 | Jehle et al. |
| 4,508,851 | A | 4/1985 | Izumi et al. |
| 4,527,581 | A | 7/1985 | Motier |
| 4,599,117 | A | 7/1986 | Luxemburg |
| 4,720,397 | A | 1/1988 | O'Mara et al. |
| 4,747,855 | A | 5/1988 | Hirai et al. |
| 4,758,354 | A | 7/1988 | O'Mara et al. |
| 4,837,249 | A | 6/1989 | O'Mara et al. |
| 5,165,440 | A | 11/1992 | Johnston |
| 5,225,081 | A | 7/1993 | Brownawell |
| 5,244,937 | A | 9/1993 | Lee et al. |
| 5,376,697 | A | 12/1994 | Johnston et al. |
| 5,449,732 | A | 9/1995 | Smith et al. |
| 5,504,132 | A | 4/1996 | Smith et al. |
| 5,539,044 | A | 7/1996 | Dindi et al. |
| 5,733,953 | A | 3/1998 | Fairchild et al. |
| 5,736,053 | A | 4/1998 | Ikushima et al. |
| 5,788,865 | A | 8/1998 | Smirnov et al. |
| 5,833,862 | A | 11/1998 | Holland |
| 5,884,777 | A | 3/1999 | Pan et al. |
| 5,888,402 | A | 3/1999 | Hommeltoft et al. |
| 5,891,324 | A | 4/1999 | Ohtsuka |
| 5,893,398 | A | 4/1999 | Garrett, Jr. |
| 5,900,153 | A | 5/1999 | Sanford |
| 6,024,880 | A | 2/2000 | Ciora, Jr. et al. |
| 6,027,653 | A | 2/2000 | Holland |
| 6,042,722 | A | 3/2000 | Lenz |
| 6,056,805 | A | 5/2000 | Litwin et al. |
| 6,082,392 | A | 7/2000 | Watkins, Jr. |
| 6,103,127 | A | 8/2000 | Pourfarzaneh |
| 6,599,337 | B2 | 7/2003 | Waynick |
| 7,018,434 | B2 * | 3/2006 | Waynick ..... 44/457 |
| 2003/0019149 | A1 | 1/2003 | Waynick |
| 2004/0015034 | A1 | 1/2004 | Waynick |
| 2004/0249233 | A1 | 12/2004 | Waynick |
| 2005/0193622 | A1 | 9/2005 | Waynick |

FOREIGN PATENT DOCUMENTS

| | | |
|---|---|---|
| GB | 1236066 | 6/1971 |
| WO | WO 02/086030 A1 | 10/2002 |
| WO | WO 04/108862 A1 | 12/2004 |
| WO | WO 05/086809 A2 | 9/2005 |
| WO | WO 05/087902 A1 | 9/2005 |

OTHER PUBLICATIONS

Natalie Marchildon, et al. The AA Graphite Deposit, Bella Coola Area, British Columbia: Exploration Implications For The Coast Plutonic Complex. (92M/15) Geological Fieldwork 1992, Paper 1993-1 p. 389-397. http://www.em.gov.bc.ca/DL/GSBPubs/GeoFldWk/1992/389-398-marchildon.pdf.

(Continued)

*Primary Examiner*—Cephia D. Toomer
(74) *Attorney, Agent, or Firm*—The Morris Law Firm PC

(57) ABSTRACT

A method for improving performance of an engine comprising contacting contaminated liquid hydrocarbon fuel comprising an initial concentration of DRA with one or more effective DRA removal agent under conditions effective to produce decontaminated liquid hydrocarbon fuel comprising a reduced concentration of the DRA, and feeding the decontaminated liquid hydrocarbon fuel to the engine.

182 Claims, No Drawings

OTHER PUBLICATIONS

Edward Matulevicius. Fuel Technology Associates. Effect of Pipeline Drag Reducer Additive on Coalescence & Filtration in Aviation Fuels. A Plan for Determining the Effect of Fully Sheard pipeline Drag Reducer Additives on Filter/Separators and Monitors. Apr. 9, 2001 http://www.crcao.com/aviation/Presentation%202001CRC%20Final%20PDR%20Plan.pdf.

The International Bureau of WIPO, International Preliminary Report on Patentability, PCT/US2005/007545, Sep. 21, 2006, 5 pgs.

U.S. Commissioner of Patents and Trademarks, International Preliminary Examination Report, PCT/US02/12302, Mar. 10, 2003, 4 pgs.

U.S. Commissioner of Patents and Trademarks, International Search Report and Written Opinion, PCT/US05/07572, Sep. 29, 2006, 6 pgs.

U.S. Commissioner of Patents and Trademarks, International Search Report and Written Opinion, PCT/US05/07542, Oct. 2, 2006, 6 pgs.

* cited by examiner

METHOD FOR IMPROVING THE PERFORMANCE OF ENGINES POWERED BY LIQUID HYDROCARBON FUEL

CROSS-REFERENCE TO RELATED APPLICATIONS

The present application is a continuation-in-part of U.S. patent application Ser. No. 10/453,803 filed on Jun. 3, 2003 now U.S. Pat. No. 7,018,434, incorporated herein by reference. The present application also is related to U.S. Pat. No. 6,599,337, incorporated herein by reference.

FIELD OF THE INVENTION

The application relates to a method for improving the performance of engines powered by liquid hydrocarbon fuel.

BACKGROUND

Materials often are added to flowing fluids in order to reduce the energy lost due to friction, or drag, thus permitting the movement of more fluid at the same differential pressure. Materials for reducing drag in flowing fluids generally are known by the generic names "flow improver" or "drag reducer additive" (sometimes referred to as "DRA").

Unfortunately, the DRA in liquid hydrocarbon fuels has the potential to cause a number of problems. Methods are needed to improve the performance of engines that use liquid hydrocarbon fuel otherwise contaminated with DRA.

SUMMARY

The present application provides a method for improving performance of an engine. The method comprises contacting contaminated liquid hydrocarbon fuel comprising an initial concentration of DRA with one or more effective DRA removal agent under conditions effective to produce decontaminated liquid hydrocarbon fuel comprising a reduced concentration of said DRA, and feeding said decontaminated liquid hydrocarbon fuel to said engine.

DETAILED DESCRIPTION

The presence of DRA in motor gasoline, even in sheared form, has caused increased intake valve deposits, plugging of fuel filters, and increased combustion chamber deposits. In jet engines, use of aviation jet fuel containing even sheared DRA has been shown to adversely affect the ability of the jet engines to reignite if a flameout occurs. In diesel fuels, DRA may cause plugging of fuel filters and strainers and/or increased fuel injector deposits. DRA is prohibited in aviation turbine fuels, although DRA has been observed as a contaminant due to accidental addition or other non-intentional means. The presence of DRA in aviation turbine fuel may result in downgrading of the entire batch to non-aviation kerosene or diesel fuel, both of which generally have less market value.

The present application provides methods for improving engine performance by contacting contaminated liquid hydrocarbon fuel comprising DRA under conditions effective to produce decontaminated liquid hydrocarbon fuel comprising a reduced concentration of DRA, and feeding the decontaminated liquid hydrocarbon fuel to the target engine. The use of the decontaminated liquid hydrocarbon fuel avoids downgrading of aviation fuels and, in other motor fuels, decreases plugging of fuel filters, and formation of deposits on intake valves, combustion chambers, fuel injectors, and will improve the reignition properties of the aviation jet fuel.

Liquid Hydrocarbon Fuel

By "liquid hydrocarbon fuel" is meant any hydrocarbon that is liquid under conditions of transport and/or storage. Suitable liquid hydrocarbon fuels include, but are not necessarily limited to those having a boiling range of from about 150° F. to about 750° F., which may be used as a fuel. In one embodiment, the liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, or bunker fuel. In a preferred embodiment, the liquid hydrocarbon fuel is selected from the group consisting of diesel fuel, jet fuel, aviation gasoline, and motor gasoline. In a more preferred embodiment, the liquid hydrocarbon fuel is jet fuel, at least in part due to the stringent requirements applicable to jet fuel and DRA. The phrase "jet fuel" refers to both commercial jet fuel (Jet A, Jet A-1, and JET B) and military jet fuel, such as JP-4, JP-5, JP-8 and the like.

DRA

The term "drag reducer additive" or "DRA" refers to any material which is added to a liquid hydrocarbon fuel to reduce fluid flow drag. DRA's include, but are not necessarily limited to polyolefin polymers and DRA's comprising polar groups.

In a preferred embodiment, the DRA includes, but is not necessarily limited to, non-polar long-chain polyolefin polymers, generally referred to as "polyalphaolefins," having a "peak" molecular weight sufficiently high to allow the polymers to reduce fluid flow drag. Suitable polyalphaolefins are believed to have a peak molecular weight of about 1 million Daltons or more, more preferably about 10 million Daltons or more, most preferably about 25 million Daltons or more. The "peak" molecular weight refers to the peak that typically is measured as the drag reducer is eluted and detected during gel permeation chromatography.

Suitable polyalphaolefins comprise polymerized linear alpha olefin (LAO) monomers having from about 2 to about 40 carbon atoms, preferably from about 2 to about 30 carbon atoms, more preferably from about 4 to about 20 carbon atoms, most preferably from about 6 to about 12 carbon atoms. An especially preferred embodiment for a DRA which is effectively removable by the activated carbons and/or graphites described herein comprises at least two different LAO's, preferably having from about 6 to about 12 carbon atoms, the number of carbon atoms of the "at least two different LAO's" differing by 6.

Polyalphaolefins having relatively high molecular weights are required to impart good drag reduction. Suitable polyalphaolefins "are made by a variety of processes, including but not necessarily limited to solution polymerization and bulk polymerization. Bulk polymerization is said to produce "ultra-high molecular weight polyolefin drag reducers [that] are significantly larger (molecular weight basis) than the best molecular weights made by solution polymerization." See U.S. Pat. No. 5,504,132. Preferred DRA's for removal according to the process described herein are made by solution polymerization.

Without limiting the invention to a specific theory or mechanism of action, the very large polyalphaolefins made by bulk polymerization may be more difficult to adsorb onto and retain on carbonaceous removal agents. In contrast, the polyalphaolefins made by solution polymerization may be more readily adsorbable onto the removal agents, and more readily retained by the removal agents.

In another embodiment, the DRA comprises polar groups. Examples of suitable polar groups include, but are not necessarily limited to organic polar groups. Organic polar groups generally comprise a moiety selected from the group consisting of oxygen, sulfur, nitrogen, halogen, phosphorus, unsaturated carbon-carbon bonds, and combinations thereof.

The DRA may comprise other components besides the polyolefin moieties. Examples of such components include, but are not necessarily limited to surfactant, catalyst residue, other additives, and other byproducts from the production of the polymer. The polymer itself may contain other non-olefin monomer units as well.

DRA's generally are unsheared, partially sheared, or fully sheared. An additive that is fully sheared is one that is degraded in molecular weight to the maximum extent possible using high shear devices such as pumps, static mixers, etc. Commercially available DRA's include, but are not necessarily limited to, CDR® Flow Improver, REFINED POWER™, and REFINED POWER II™, manufactured by ConocoPhillips; EN-660 Flow Improver, manufactured by Energy 2000 LLC; and FLO®XS and FLO®XL, manufactured by Baker Petrolite. In a preferred embodiment, the DRA is FLO®XS and equivalents thereof.

As liquids containing DRA travel through pumps, pipelines and other equipment, the DRA typically degrades through shearing action, resulting in a reduction in the molecular weight of the DRA. The degraded DRA generally is sheared or partially sheared DRA. Upon reaching the ultimate destination, the contaminated liquid hydrocarbon fuel may contain a significant amount of DRA, including that in the sheared and partially sheared form. This DRA is sometimes referred to herein and in the claims as the "initial concentration of DRA."

Removal Agents

According to the present application, the contaminated liquid hydrocarbon fuel comprising an initial concentration of DRA is contacted with one or more effective removal agents under conditions effective to produce "decontaminated liquid hydrocarbon fuel" comprising a reduced amount of DRA. The decontaminated liquid hydrocarbon fuel is fed to the engine.

Suitable removal agents are effective to achieve a % DRA removal of about 10% or more when 1 g of the removal agent is added (in increments with agitation) to 100 ml. of contaminated liquid hydrocarbon fuel comprising from about 8 to about 12 ppm of unsheared target DRA. Preferred removal agents achieve a % DRA removal of about 20% or more, preferably 30% or more; more preferably about 40% or more under the same conditions.

Examples of suitable removal agents include, but are not necessarily limited to graphites, activated carbons, and fresh attapulgus clay.

Graphites

Preferred DRA removal agents are graphites. Graphite is a crystalline form of carbon found as a naturally occurring mineral in many locations around the world. Graphite can be amorphous ("amorphous graphite"). Graphite also can have a perfect basal cleavage which, coupled with its extreme softness, gives it an oily, slippery feel. Suitable graphites include, but are not necessarily limited to natural graphites, synthetic graphites, and expanded graphites. Each of these graphites is commercially available in various forms, including, crystalline lumps, crystalline large flakes, crystalline medium flakes, crystalline small flakes, and powder form. Artificial graphite can be manufactured from petroleum coke and is primarily used to make electrodes. The virgin by-product of such electrode production has a carbon content as high as 99.9%, and can be a relatively inexpensive source of graphite agent, to highly refined natural graphite. Suitable candidate graphites are commercially available, for example, from Asbury Carbons, Inc., Asbury, N.J.; Superior Graphite Co., Chicago, Ill.; Stanford Materials Corporation, Aliso Viejo, Calif.; and others.

Preferred graphites are selected from the group consisting of graphite powders and graphite particulates. The graphite particulates preferably are granular and have an average diameter of from about 0.01 microns to about 10,000 microns; preferably from about 0.1 microns to about 1,000 microns; most preferably about 1 micron to about 100 microns. Preferred graphites have a porosity sufficient to provide an adsorption capacity of about 0.01 wt. % or more, preferably about 0.03 wt. % or more, most preferably about 0.04 wt % or more, when exposed to a preferred DRA. Suitable and preferred graphites are commercially available from Superior Graphite Company. Preferred graphite products comprise, but are not necessarily limited to, purified carbon, natural graphite, silica (crystalline quartz), and synthetic graphite.

Graphites that demonstrated commercial viability for adsorbing unsheared and sheared BAKER PETROLITE FLO® XS and equivalents included GRAPHITE 2126, GRAPHITE 2139, GRAPHITE 3726, GRAPHITE 3739, GRAPHITE 5526, GRAPHITE 5539, GRAPHITE 9026, GRAPHITE 9039, and GRAPHITE GA-17, available from Superior Graphite Co. The foregoing graphites exhibited an adsorption capacity for unsheared and sheared BAKER PETROLITE FLO® XS of about 0.01 wt % or more.

Preferred commercially available graphites for adsorbing unsheared BAKER PETROLITE FLO® XS and equivalents included GRAPHITE 2126, GRAPHITE 2139, GRAPHITE 3726, GRAPHITE 3739, GRAPHITE 5539, GRAPHITE 9039, and GRAPHITE GA-17. The foregoing graphites exhibited an adsorption capacity for unsheared BAKER PETROLITE FLO® XS of about 0.02 wt % or more. Preferred commercially available graphites for adsorbing sheared BAKER PETROLITE FLO® XS and equivalents included GRAPHITE 2126, GRAPHITE 2139, GRAPHITE 3726, GRAPHITE 3739, GRAPHITE 9026, and GRAPHITE 9039. The foregoing graphites exhibited an adsorption capacity for sheared BAKER PETROLITE FLO® XS of about 0.018 wt % or more.

Even more preferred commercially available graphites for adsorbing unsheared BAKER PETROLITE FLO® XS and equivalents included GRAPHITE 2139, GRAPHITE 3726, GRAPHITE 3739, GRAPHITE 5539, GRAPHITE 9039, and GRAPHITE GA-17. The foregoing graphites exhibited an adsorption capacity for unsheared BAKER PETROLITE FLO® XS of about 0.03 wt % or more.

Most preferred graphites, particularly for adsorbing unsheared BAKER PETROLITE FLO® XS and equivalents thereof, include but are not necessarily limited to GRAPHITE 2139 and GRAPHITE 3739. The foregoing graphites exhibited an adsorption capacity for unsheared BAKER PETROLITE FLO® XS of about 0.04 wt % or more. Most preferred graphites, particularly for adsorbing sheared BAKER PETROLITE FLO® XS and equivalents thereof, include but are not necessarily limited to GRAPHITE 3726 and GRAPHITE 3739. The foregoing graphites exhibited an adsorption capacity for sheared BAKER PETROLITE FLO® XS of about 0.025 wt % or more.

Activated Carbons

Suitable activated carbons for use as effective removal agents are identified in U.S. Pat. No. 6,599,337, which has been incorporated herein by reference. Suitable activated carbons are commercially available, for example, from Allchem Industries, Inc., Beta Chemicals, Calgon, Coyne Chemical Co., Elf Atochem North America, Inc. (Performance Products), R. W. Greef & Co, Inc., Kingshine Chemical Co., Ltd., Mays Chemical Co., Inc., Mitsubishi International Corp. (Industrial Specialty Chemicals Div.), Spectrum Chemical Mfg. Corp., Norit Americas, Inc. and others.

Commercially viable activated carbons, which have been demonstrated to be suitable to remove Baker Petrolite FLO® XS and equivalents thereof include, but are not necessarily limited to, CALGON ADP, CALGON COLORSORB, CALGON WPX, NORIT A SUPRA, NORIT CA 1, NORIT FGD, NORIT HDB, SXO POWDER, and CARBON 5565. Preferred activated carbons demonstrated to be useful for removing Baker Petrolite FLO® XS and equivalents thereof include, but are not necessarily limited to CALGON WPX, NORIT A SUPRA, NORIT CA1, NORIT FGD, NORIT HDB, SXO POWDER and CARBON 5565. Most preferred activated carbons demonstrated to be useful for removing Baker Petrolite FLO® XS and equivalents thereof include, but are not necessarily limited to NORIT A SUPRA, NORIT CA1, NORIT FGD, and NORIT HDB.

Fresh Attapulgus Clay

Also suitable for use as a removal agent is fresh attapulgus clay. "Fresh" attapulgus clay is effective to remove about 10% or more of a target DRA when 1 g of the attapulgus clay is added in increments of from about 0.02 gram to about 0.1 gram, with agitation, to 100 ml. of contaminated liquid hydrocarbon fuel comprising from about 8 to about 12 ppm of the unsheared target DRA.

Attapulgus clay generally comprises granules comprising a conglomerate of fundamental particles. A majority of the granules typically have a mesh size of from about 30 to about 90.

Removal of DRA from Liquid Hydrocarbon Fuels

The contaminated liquid hydrocarbon DRA is contacted with the DRA removal agent(s) using any suitable method. A preferred method for use, particularly with relatively viscous fuel, comprises incremental addition of the DRA and agitation of the resulting mixture. Due to the difficulty in providing for incremental addition and agitation in most commercial situations, it may be preferred to simply pass the contaminated liquid hydrocarbon fuel through a bed comprising one or more effective removal agent(s) until the bed DRA removal rate is so low that the bed must be regenerated or replaced.

In a preferred embodiment, the removal agent is incorporated into a system for filtering the contaminated liquid hydrocarbon fuel to remove the DRA. The construction and type of filter will vary depending upon the liquid hydrocarbon fuel to be treated and the location of treatment.

Suitable locations for the filter system comprising the DRA removal agent include, but are not necessarily limited to: at a refinery; between a refinery and a fuel terminal; at a fuel terminal; between two different fuel terminals; between a fuel terminal and an airport storage tank; at an airport storage tank; between a fuel terminal and a tanker truck; at a tanker truck; between an airport storage tank and a tanker truck; between two different tanker trucks; between a tanker truck and an engine, at a fuel dispenser (such as a gasoline pump); between a fuel dispenser and a vehicle comprising the engine; and, at the engine.

The removal agent may or may not be preheated prior to use to a temperature effective to remove any adsorbed water without damaging the removal agent(s).

Fuel Delivery to Engine

Once the liquid hydrocarbon fuel is treated with the effective removal agent under conditions effective to produce decontaminated liquid hydrocarbon fuel, the decontaminated liquid hydrocarbon fuel is fed to the target engine using known methods and devices.

Persons of ordinary skill in the art will recognize that many modifications may be made to the foregoing without departing from the spirit and scope thereof. The embodiment described herein is meant to be illustrative only and should not be taken as limiting the invention, which is defined in the following claims.

I claim:

1. A method for improving performance of an engine comprising:

contacting contaminated liquid hydrocarbon fuel comprising an initial concentration of drag reducer additive ("DRA") with one or more effective DRA removal agent(s) under conditions effective to produce decontaminated liquid hydrocarbon fuel comprising a reduced concentration of said DRA; and, feeding said decontaminated liquid hydrocarbon fuel to said engine.

2. The method of claim 1 wherein said one or more effective DRA removal agents achieve a % DRA removal of about 10% or more when 1 g of the DRA removal agent is added in increments with agitation to 100 ml. of contaminated liquid hydrocarbon fuel comprising from about 8 to about 12 ppm of unsheared target DRA.

3. The method of claim 2 wherein said % DRA removal is about 20% or more.

4. The method of claim 2 wherein said % DRA removal is about 30% or more.

5. The method of claim 2 wherein said % DRA removal is about 40% or more.

6. A method for improving performance of an engine comprising:

contacting contaminated liquid hydrocarbon fuel comprising an initial concentration of drag reducer additive with one or more effective DRA removal agent(s) selected from the group consisting of graphites, activated carbons, fresh attapulgus clay, and combinations thereof, under conditions effective to produce decontaminated liquid hydrocarbon fuel comprising a reduced concentration of said DRA; and, feeding said decontaminated liquid hydrocarbon fuel to said engine.

7. The method of claim 6 wherein said one or more DRA removal agents have an adsorption capacity of about 0.03 wt. % or more.

8. The method of claim 6 wherein said conditions comprise incremental addition of the DRA removal agent(s) and agitation of the resulting mixture.

9. The method of claim 6 wherein said conditions comprise passing the contaminated liquid hydrocarbon fuel through a bed comprising said one or more effective DRA removal agent(s).

10. The method of claim 9 wherein said contacting produces used DRA removal agent(s), said method further comprising replacing said used DRA removal agent(s) with fresh DRA removal agent(s).

11. The method of claim 6 wherein said contacting said contaminated liquid hydrocarbon fuel comprising an initial concentration of DRA with one or more effective DRA removal agent(s) occurs at a location selected from the group consisting of: at a refinery; between a refinery and a fuel terminal; at a fuel terminal; between two different fuel terminals; between a fuel terminal and an airport storage tank; at an airport storage tank; between a fuel terminal and a tanker truck; at a tanker truck, between an airport storage tank and a tanker truck; between two different tanker trucks; between a tanker truck and an engine, at a fuel dispenser; between a fuel dispenser and a vehicle comprising the engine; and, at the engine.

12. The method of claim 6 further comprising preheating said one or more removal agents prior to use under conditions effective to remove adsorbed water without damaging the removal agent(s).

13. The method of claim 6 wherein said reduced concentration of DRA is sufficiently low to perform one or more function selected from the group consisting of permitting reignition of jet fuel after flameout, decreasing plugging of fuel filters and reducing formation of deposits on engine components.

14. The method of claim 6 wherein said liquid hydrocarbon fuel has a boiling range of from about 150° F. to about 750° F.

15. The method of claim 6 wherein said liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, or bunker fuel.

16. The method of claim 6 wherein said liquid hydrocarbon fuel is selected from the group consisting of diesel fuel, jet fuel, aviation gasoline, and motor gasoline.

17. The method of claim 6 wherein said liquid hydrocarbon fuel is jet fuel.

18. The method of claim 17 wherein said reduced concentration of DRA is sufficiently low to permit reignition of jet fuel after flameout.

19. The method of claim 6 wherein said drag reducer additive comprises one or more polyalphaolefins having a peak molecular weight of about 1 million Daltons or more.

20. The method of claim 6 wherein said drag reducer additive comprises one or more polyolefins having a peak molecular weight of about 10 million Daltons or more.

21. The method of claim 6 wherein said DRA comprises two different linear alpha olefins (LAO's) or more having from about 6 to about 12 carbon atoms, the number of carbon atoms of the at least two different LAO's differing by 6.

22. The method of claim 6 wherein said DRA comprises one or more polyalphaolefins made by solution polymerization.

23. The method of claim 6 wherein said DRA comprises polar groups.

24. The method of claim 23 wherein said DRA comprises organic polar groups.

25. The method of claim 23 wherein said polar groups comprise a moiety selected from the group consisting of oxygen, sulfur, nitrogen, halogen, phosphorus, unsaturated carbon-carbon bonds, and combinations thereof.

26. The method of claim 24 wherein said organic polar groups comprise a moiety selected from the group consisting of oxygen, sulfur, nitrogen, halogen, phosphorus, unsaturated carbon-carbon bonds, and combinations thereof.

27. A method for improving performance of an engine comprising:

contacting contaminated liquid hydrocarbon fuel comprising an initial concentration of drag reducer additive ("DRA") with one or more effective DRA removal agent comprising graphite under conditions effective to produce decontaminated liquid hydrocarbon fuel comprising a reduced concentration of said DRA; and, feeding said decontaminated liquid hydrocarbon fuel to said engine.

28. The method of claim 27 wherein said graphite is selected from the group consisting of graphite powders and graphite particulates having an adsorption capacity of about 0.01 wt. % or more.

29. The method of claim 27 wherein said graphite comprises granules.

30. The method of claim 28 wherein said graphite comprises granules.

31. The method of claim 27 wherein said graphite comprises granules.

32. The method of claim 28 wherein said graphite comprises granules.

33. The method of claim 27 wherein said graphite comprises granules.

34. The method of claim 28 wherein said graphite comprises granules.

35. The method of claim 27 wherein said graphite is selected from the group consisting of graphite powders and graphite particulates having an adsorption capacity of about 0.03 wt. % or more.

36. The method of claim 29 wherein said graphite has an adsorption capacity of about 0.03 wt. % or more.

37. The method of claim 32 wherein said graphite has an adsorption capacity of about 0.03 wt. % or more.

38. The method of claim 34 wherein said graphite has an adsorption capacity of about 0.03 wt. % or more.

39. The method of claim 9 wherein said one or more effective DRA removal agents have an adsorption capacity of about 0.04 wt % or more.

40. The method of claim 27 wherein said graphite has an adsorption capacity of about 0.04 wt %.

41. The method of claim 27 wherein said graphite is selected from the group consisting of natural graphites, synthetic graphites, expanded graphites, and combinations thereof.

42. The method of claim 41 wherein said graphite is selected from the group consisting of purified carbon, natural graphite, silica (crystalline quartz), synthetic graphite, and combinations thereof.

43. The method of claim 35 wherein said graphite is selected from the group consisting of purified carbon, natural graphite, silica (crystalline quartz), synthetic graphite, and combinations thereof.

44. The method of claim 28 wherein said conditions comprise incremental addition of the DRA removal agent(s) and agitation of the resulting mixture.

45. The method of claim 28 wherein said conditions comprise passing the contaminated liquid hydrocarbon fuel through a bed comprising said one or more effective DRA removal agent(s).

46. The method of claim 45 wherein said contacting produces used DRA removal agent(s), said method further comprising replacing said used DRA removal agent(s) with fresh DRA removal agent(s).

47. The method of claim 28 wherein said contacting said contaminated liquid hydrocarbon fuel comprising an initial concentration of DRA with one or more effective DRA removal agent(s) occurs at a location selected from the group consisting of: at a refinery; between a refinery and a fuel terminal; at a fuel terminal; between two different fuel terminals; between a fuel terminal and an airport storage tank; at an airport storage tank; between a fuel terminal and a tanker truck; at a tanker truck; between an airport storage tank and a tanker truck; between two different tanker trucks; between a tanker truck and an engine, at a fuel dispenser; between a fuel dispenser and a vehicle comprising the engine; and, at the engine.

48. The method of claim 28 further comprising preheating said one or more removal agents prior to use under conditions effective to remove adsorbed water without damaging the removal agent(s).

49. The method of claim 28 wherein said reduced concentration of DRA is sufficiently low to perform one or more function selected from the group consisting of permitting reignition of jet fuel after flameout, decreasing plugging of fuel filters and reducing formation of deposits on engine components.

50. The method of claim 28 wherein said liquid hydrocarbon fuel has a boiling range of from about 150° F. to about 750° F.

51. The method of claim 28 wherein said liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, and bunker fuel.

52. The method of claim 28 wherein said liquid hydrocarbon fuel is selected from the group consisting of diesel fuel, jet fuel, aviation gasoline, and motor gasoline.

53. The method of claim 28 wherein said liquid hydrocarbon fuel is jet fuel.

54. The method of claim 53 wherein said reduced concentration of DRA is sufficiently low to permit reignition of jet fuel after flameout.

55. The method of claim 28 wherein said drag reducer additive comprises one or more polyalphaolefins having a peak molecular weight of about 1 million Daltons or more.

56. The method of claim 28 wherein said drag reducer additive comprises one or more polyalphaolefins having a peak molecular weight of about 10 million Daltons or more.

57. The method of claim 28 wherein said DRA comprises two different linear alpha olefins (LAO's) or more having from about 6 to about 12 carbon atoms, the number of carbon atoms of the at least two different LAO's differing by 6.

58. The method of claim 28 wherein said DRA comprises one or more polyalphaolefins made by solution polymerization.

59. The method of claim 28 wherein said DRA comprises polar groups.

60. The method of claim 59 wherein said DRA comprises organic polar groups.

61. The method of claim 59 wherein said polar groups comprise a moiety selected from the group consisting of oxygen, sulfur, nitrogen, halogen, phosphorus, unsaturated carbon-carbon bonds, and combinations thereof.

62. The method of claim 60 wherein said organic polar groups comprise a moiety selected from the group consisting of oxygen, sulfur, nitrogen, halogen, phosphorus, unsaturated carbon-carbon bonds, and combinations thereof.

63. A method for improving performance of an engine comprising:

contacting contaminated liquid hydrocarbon fuel comprising an initial concentration of drag reducer additive ("DRA") with one or more effective DRA removal agent(s) comprising activated carbon under conditions effective to produce decontaminated liquid hydrocarbon fuel comprising a reduced concentration of said DRA; and, feeding said decontaminated liquid hydrocarbon fuel to said engine.

64. The method of claim 63 wherein said activated carbon has an adsorption capacity of about 0.01 wt. % or more.

65. The method of claim 63 wherein said activated carbon has an adsorption capacity of about 0.02 wt. % or more.

66. The method of claim 63 wherein said activated carbon has an adsorption capacity of about 0.03 wt. % or more.

67. The method of claim 64 wherein said conditions comprise incremental addition of the DRA removal agent(s) and agitation of the resulting mixture.

68. The method of claim 64 wherein said conditions comprise passing the contaminated liquid hydrocarbon fuel trough a bed comprising said one or more effective DRA removal agent(s).

69. The method of claim 68 wherein said contacting produces used DRA removal agent(s), said method filer comprising replacing said used DRA removal agent(s) with fresh DRA removal agent(s).

70. The method of claim 64 wherein said contacting said contaminated liquid hydrocarbon fuel comprising an initial concentration of DRA with one or more effective DRA removal agent(s) occurs at a location selected from the group consisting of: at a refinery; between a refinery and a fuel terminal; at a fuel terminal; between two different fuel terminals; between a fuel terminal and an airport storage tank; at an airport storage tank; between a fuel terminal and a tanker truck; at a tanker truck; between an airport storage tank and a tanker truck; between two different tanker trucks; between a tanker truck and an engine, at a fuel dispenser, between a fuel dispenser and a vehicle comprising the engine; and, at the engine.

71. The method of claim 64 further comprising preheating said one or more removal agents prior to use under conditions effective to remove adsorbed water without damaging the removal agent(s).

72. The method of claim 64 wherein said reduced concentration of DRA is sufficiently low to perform one or more function selected from the group consisting of permitting reignition of jet fuel after flameout, decreasing plugging of fuel filters, and reducing formation of deposits on engine components.

73. The method of claim 64 wherein said liquid hydrocarbon fuel has a boiling range of from about 150° F. to about 750° F.

74. The method of claim 64 wherein said liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No. 2 oil, residual fuel, No. 6 fuel, and bunker fuel.

75. The method of claim 64 wherein said liquid hydrocarbon fuel is selected from the group consisting of diesel fuel, jet fuel, aviation gasoline, and motor gasoline.

76. The method of claim 64 wherein said liquid hydrocarbon fuel is jet fuel.

77. The method of claim 76 wherein said reduced concentration of DRA is sufficiently low to permit reignition of jet fuel after flameout.

78. The method of claim 64 wherein said drag reducer additive comprises one or more polyalphaolefins having a peak molecular weight of about 1 million Daltons or more.

79. The method of claim 64 wherein said drag reducer additive comprises one or more polyalphaolefins having a peak molecular weight of about 10 million Daltons or more.

80. The method of claim 64 wherein said DRA comprises two different linear alpha olefins (LAO's) or more having from about 6 to about 12 carbon atoms, the number of carbon atoms of the at least two different LAO's differing by 6.

81. The method of claim 64 wherein said DRA comprises one or more polyalphaolefins made by solution polymerization.

82. The method of claim 64 wherein said DRA comprises polar groups.

83. The method of claim 82 wherein said DRA comprises organic polar groups.

84. The method of claim 82 wherein said polar groups comprise a moiety selected from the group consisting of oxygen, sulfur, nitrogen, halogen, phosphorus, unsaturated carbon-carbon bonds, and combinations thereof.

85. The method of claim 83 wherein said organic polar groups comprise a moiety selected from the group consisting of oxygen, sulfur, nitrogen, halogen, phosphorus, unsaturated carbon-carbon bonds, and combinations thereof.

86. A method for improving performance of an engine comprising:

contacting contaminated liquid hydrocarbon fuel comprising an initial concentration of DRA with fresh attapulgus clay under conditions effective to produce decontaminated liquid hydrocarbon fuel comprising a reduced concentration of said DRA; and, feeding said decontaminated liquid hydrocarbon fuel to said engine.

87. The method of claim 86 wherein said fresh attapulgus clay is effective to remove about 10% or more of said DRA when 1 g of the fresh attapulgus clay is added in increments of from about 0.02 gram to about 0.1 gram, with agitation, to 100 ml. of contaminated liquid hydrocarbon fuel comprising from about 8 to about 12 ppm of the unsheared DRA.

88. The method of claim 87 wherein said fresh attapulgus clay comprises granules, a majority of said granules having a mesh size of from about 30 to about 90.

89. The method of claim 87 wherein said conditions comprise incremental addition of the DRA removal agent(s) and agitation of the resulting mixture.

90. The method of claim 87 wherein said conditions comprise passing the contaminated liquid hydrocarbon fuel through a bed comprising said one or more effective DRA removal agent(s).

91. The method of claim 90 wherein said contacting produces used DRA removal agent(s), said method further comprising replacing said used DRA removal agent(s) with fresh DRA removal agents.

92. The method of claim 87 wherein said contacting said contaminated liquid hydrocarbon fuel comprising an initial concentration of DRA with one or more effective DRA removal agent(s) occurs at a location selected from the group consisting of: at a refinery; between a refinery and a fuel terminal; at a fuel terminal; between two different fuel terminals; between a fuel terminal and an airport storage tank; at an airport storage tank; between a fuel terminal and a tanker truck; at a tanker truck; between an airport storage tank and a tanker truck; between two different tanker trucks; between a tanker truck and an engine, at a fuel dispenser; between a fuel dispenser and a vehicle comprising the engine; and, at the engine.

93. The method of claim 87 further comprising preheating said one or more removal agents prior to use under conditions effective to remove adsorbed water without damaging the removal agent(s).

94. The method of claim 87 wherein said reduced concentration of DRA is sufficiently low to perform one or more function selected from the group consisting of permitting reignition of jet fuel after flameout, decreasing plugging of fuel filters and reducing formation of deposits on engine components.

95. The method of claim 87 wherein said liquid hydrocarbon fuel has a boiling range of from about 150° F. to about 750° F.

96. The method of claim 87 wherein said liquid hydrocarbon fuel is selected from the group consisting of liquefied natural gas (LNG), liquefied petroleum gas (LPG), motor gasoline, aviation gasoline, distillate fuels such as diesel fuel and home heating oil, kerosene, jet fuel, No 2 oil, residual fuel, No. 6 fuel, and bunker fuel.

97. The method of claim 87 wherein said liquid hydrocarbon fuel is selected from the group consisting of diesel fuel, jet fuel, aviation gasoline, and motor gasoline.

98. The method of claim 87 wherein said liquid hydrocarbon fuel is jet fuel.

99. The method of claim 98 wherein said reduced concentration of DRA is sufficiently low to permit reignition of jet fuel after flameout.

100. The method of claim 87 wherein said drag reducer additive comprises one or more polyalphaolefins having a peak molecular weight of about 1 million Daltons or more.

101. The method of claim 87 wherein said drag reducer additive comprises one or more polyalphaolefins having a peak molecular weight of about 10 million Daltons or more.

102. The method of claim 87 wherein said DRA comprises two different linear alpha olefins (LAO's) or more having from about 6 to about 12 carbon atoms, the number of carbon atoms of the at least two different LAO's differing by 6.

103. The method of claim 87 wherein said DRA comprises one or more polyalphaolefins made by solution polymerization.

104. The method of claim 87 wherein said DRA comprises polar groups.

105. The method of claim 104 wherein said DRA comprises organic polar groups.

106. The method of claim 104 wherein said polar groups comprise a moiety selected from the group consisting of oxygen, sulfur, nitrogen, halogen, phosphorus, unsaturated carbon-carbon bonds, and combinations thereof.

107. The method of claim 104 wherein said organic polar groups comprise a moiety selected from the group consisting of oxygen, sulfur, nitrogen, halogen, phosphorus, unsaturated carbon-carbon bonds, and combinations thereof.

108. A method for reigniting jet fuel previously contaminated with DRA after flameout comprising:

feeding to a jet engine decontaminated jet fuel comprising a reduced concentration of DRA, said reduced concentration of DRA being produced by contacting contaminated jet fuel comprising an initial concentration of DRA with one or more effective DRA removal agent(s) under conditions effective to produce said decontaminated jet fuel; and, feeding said decontaminated jet fuel to a jet engine, said reduced concentration of DRA being sufficiently low to permit reignition of jet fuel after flameout.

109. The method of claim 108 wherein said one or more effective DRA removal agents achieve a % DRA removal of about 10% or more when 1 g of the DRA removal agent is added in increments with agitation to 100 ml. of contaminated jet fuel comprising from about 8 to about 12 ppm of unsheared target DRA.

110. The method of claim 109 wherein said % DRA removal is about 20% or more.

111. The method of claim 109 wherein said % DRA removal is about 30% or more.

112. The method of claim 109 wherein said % DRA removal is about 40% or more.

113. The method of claim 108 wherein said one or more effective DRA removal agent(s) are selected from the group consisting of graphites, activated carbons, fresh attapulgus clay, and combinations thereof.

114. The method of claim 113 wherein said one or more DRA removal agents have an adsorption capacity of about 0.03 wt. % or more.

115. The method of claim 113 wherein said conditions comprise incremental addition of the DRA removal agent(s) and agitation of the resulting mixture.

116. The method of claim 113 wherein said conditions comprise passing the contaminated jet fuel through a bed comprising said one or more effective DRA removal agent (s).

117. The method of claim 116 wherein said contacting produces used DRA removal agent(s), said method further comprising replacing said used DRA removal agent(s) with fresh DRA removal agent(s).

118. The method of claim 113 wherein said contacting said contaminated jet fuel comprising an initial concentration of DRA with one or more effective DRA removal agent(s) occurs at a location selected from the group consisting of: at a refinery; between a refinery and a fuel terminal; at a fuel terminal; between two different fuel terminals; between a fuel terminal and an airport storage tank; at an it storage tank; between a fuel terminal and a tanker truck; at a tanker truck; between an airport storage tank and a tanker truck; between two different tanker trucks; between a tanker truck and an engine, at a fuel dispenser; between a fuel dispenser and a jet; at the jet engine.

119. The method of claim 113 further comprising preheating said one or more removal agents prior to use under conditions effective to remove adsorbed water without damaging the removal agent(s).

120. The method of claim 113 wherein said drag reducer additive comprises a polyalphaolefin having a peak molecular weight of about 1 million Daltons or more.

121. The method of claim 113 wherein said polyalphaolefin has a peak molecular weight of about 10 million Daltons or more.

122. The method of claim 113 wherein said DRA comprises two different linear alpha olefins (LAO's) or more having from about 6 to about 12 carbon atoms, the number of carbon atoms of the at least two different LAO's differing by 6.

123. The method of claim 113 wherein said DRA comprises one or more polyalphaolefins made by solution polymerization.

124. The method of claim 113 wherein said DRA comprises polar groups.

125. The method of claim 124 wherein said DRA comprises organic polar groups.

126. The method of claim 124 wherein said polar groups comprise a moiety selected from the group consisting of oxygen, sulfur, nitrogen, halogen, phosphorus, unsaturated carbon-carbon bonds, and combinations thereof.

127. The method of claim 125 wherein said organic polar groups comprise a moiety selected from the group consisting of oxygen, sulfur, nitrogen, halogen, phosphorus, unsaturated carbon-carbon bonds, and combinations thereof.

128. The method of claim 108 wherein said one or more effective DRA removal agent(s) comprise graphite.

129. The method of claim 128 wherein said graphite achieves a % DRA removal of about 10% or more when 1 g of graphite is added in increments with agitation to 100 ml. of contaminated jet fuel comprising from about 8 to about 12 ppm of unsheared target DRA.

130. The method of claim 128 wherein said % DRA removal is about 20% or more.

131. The method of claim 128 wherein said % DRA removal is about 30% or more.

132. The method of claim 128 wherein said % DRA removal is about 40% or more.

133. The method of claim 128 wherein said graphite is selected from the group consisting of graphite powders and graphite particulates having an adsorption capacity of about 0.01 wt. % or more.

134. The method of claim 128 wherein said graphite comprises granules.

135. The method of claim 128 wherein said graphite comprises granules having an average diameter of from about 0.1 microns to about 1,000 microns.

136. The method of claim 128 wherein said graphite comprises granules.

137. The method of claim 128 wherein said graphite is selected from the group consisting of graphite powders and graphite particulates having an adsorption capacity of about 0.03 wt. % or more.

138. The method of claim 128 wherein said conditions comprise incremental addition of the DRA removal agent(s) and agitation of the resulting mixture.

139. The method of claim 128 wherein said conditions comprise passing the contaminated jet fuel through a bed comprising said one or more effective DRA removal agent (s).

140. The method of claim 139 wherein said contacting produces used DRA removal agent(s), said method further comprising replacing said used DRA removal agent(s) with fresh DRA removal agent(s).

141. The method of claim 128 further comprising preheating said one or more removal agents prior to use under conditions effective to remove adsorbed water without damaging the removal agent(s).

142. The method of claim 128 wherein said drag reducer additive comprises a polyalphaolefin having a peak molecular weight of about 1 million Daltons or more.

143. The method of claim 128 wherein said polyalphaolefin has a peak molecular weight of about 10 million Daltons or more.

144. The method of claim 128 wherein said DRA comprises two different linear alpha olefins (LAO's) or more having from about 6 to about 12 carbon atoms, the number of carbon atoms of the at least two different LAO's differing by 6.

145. The method of claim 128 wherein said DRA comprises one or more polyalphaolefins made by solution polymerization.

146. The method of claim 128 wherein said DRA comprises polar groups.

147. The method of claim 128 wherein said DRA comprises organic polar groups.

148. The method of claim 146 wherein said polar groups comprise a moiety selected from the group consisting of oxygen, sulfur, nitrogen, halogen, phosphorus, unsaturated carbon-carbon bonds, and combinations thereof.

149. The method of claim 108 wherein said one or more effective DRA removal agent comprises activated carbon.

150. The method of claim 149 wherein said conditions comprise incremental addition of the DRA removal agent(s) and agitation of the resulting mixture.

151. The method of claim 149 wherein said conditions comprise passing the contaminated liquid hydrocarbon fuel through a bed comprising said one or more effective DRA removal agent(s).

152. The method of claim 149 wherein said contacting produces used DRA removal agent(s), said method further comprising replacing said used DRA removal agent(s) with fresh DRA removal agent(s).

153. The method of claim 149 further comprising preheating said one or more removal agents prior to use under conditions effective to remove adsorbed water without damaging the removal agent(s).

154. The method of claim 149 wherein said drag reducer additive comprises a polyalphaolefin having a peak molecular weight of about 1 million Daltons or more.

155. The method of claim 149 wherein said polyalphaolefin has a peak molecular weight of about 10 million Daltons or more.

156. The method of claim 149 wherein said DRA comprises two different linear alpha olefins (LAO's) or more having from about 6 to about 12 carbon atoms, the number of carbon atoms of the at least two different LAO's differing by 6.

157. The method of claim 149 wherein said DRA comprises one or more polyalphaolefins made by solution polymerization.

158. The method of claim 149 wherein said DRA comprises polar groups.

159. The method of claim 149 wherein said DRA comprises organic polar groups.

160. The method of claim 149 wherein said polar groups comprise a moiety selected from the group consisting of oxygen, sulfur, nitrogen, halogen, phosphorus, unsaturated carbon-carbon bonds, and combinations thereof.

161. The method of claim 149 wherein said activated carbon has an adsorption capacity of about 0.01 wt. % or more.

162. The method of claim 149 wherein said activated carbon has an adsorption capacity of about 0.02 wt. % or more.

163. The method of claim 149 wherein said activated carbon has an adsorption capacity of about 0.03 wt. % or more.

164. The method of claim 149 wherein said activated carbon achieves a % DRA removal of about 10% or more when 1 g of activated carbon is added in increments with agitation to 100 ml. of contaminated jet fuel comprising from about 8 to about 12 ppm of unsheared target DRA.

165. The method of claim 149 wherein said % DRA removal is about 20% or more.

166. The method of claim 128 wherein said % DRA removal is about 30% or more.

167. The method of claim 108 wherein said one or more effective DRA removal agent comprises fresh attapulgus clay.

168. The method of claim 167 wherein said fresh attapulgus clay comprises granules, a majority of said granules having a mesh size of from about 30 to about 90.

169. The method of claim 167 wherein said conditions comprise incremental addition of the DRA removal agent(s) and agitation of the resulting mixture.

170. The method of claim 167 wherein said conditions comprise passing the contaminated jet fuel through a bed comprising said one or more effective DRA removal agent (s).

171. The method of claim 167 wherein said contacting produces used DRA removal agent(s), said method further comprising replacing said used DRA removal agent(s) with fresh DRA removal agent(s).

172. The method of claim 167 further comprising preheating said one or more removal agents prior to use under conditions effective to remove adsorbed water without damaging the removal agent(s).

173. The method of claim 167 wherein said drag reducer additive comprises a polyalphaolefin having a peak molecular weight of about 1 million Daltons or more.

174. The method of claim 167 wherein said polyalphaolefin has a peak molecular weight of about 10 million Daltons or more.

175. The method of claim 167 wherein said DRA comprises two different linear alpha olefins (LAO's) or more having from about 6 to about 12 carbon atoms, the number of carbon atoms of the at least two different LAO's differing by 6.

176. The method of claim 167 wherein said DRA comprises one or more polyalphaolefins made by solution polymerization.

177. The method of claim 167 wherein said DRA comprises polar groups.

178. The method of claim 167 wherein said DRA comprises organic polar groups.

179. The method of claim 167 wherein said polar groups comprise a moiety selected from the group consisting of oxygen, sulfur, nitrogen, halogen, phosphorus, unsaturated carbon-carbon bonds, and combinations thereof.

180. The method of claim 167 wherein said fresh attapulgus clay achieves a % DRA removal of about 10% or more when 1 g of fresh attapulgus clay is added in increments with agitation to 100 ml. of contaminated jet fuel comprising from about 8 to about 12 ppm of unsheared target DRA.

181. The method of claim 167 wherein said % DRA removal is about 20% or more.

182. The method of claim 167 wherein said % DRA removal is about 30% or more.

* * * * *